US006763804B2

(12) United States Patent
Pursifull

(10) Patent No.: US 6,763,804 B2
(45) **Date of Patent: *Jul. 20, 2004**

(54) ELECTRONIC THROTTLE SERVO OVERHEAT PROTECTION SYSTEM

(75) Inventor: Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 100 days.

This patent is subject to a terminal disclaimer.

(21) Appl. No.: 09/973,030

(22) Filed: Oct. 9, 2001

(65) Prior Publication Data

US 2003/0066513 A1 Apr. 10, 2003

(51) Int. Cl.[7] ..... F02D 41/08
(52) U.S. Cl. ..... 123/396; 123/399; 318/635
(58) Field of Search ..... 318/563, 565, 318/626, 566, 635; 123/396, 397, 399, 339.15, 339.16, 568.24; 251/129.11, 129.12, 129.13

(56) References Cited

U.S. PATENT DOCUMENTS 4,656,407 A 4/1987 Burney
4,819,597 A 4/1989 Gale et al.
5,115,396 A * 5/1992 Keegan ..... 701/102
5,327,056 A 7/1994 Loreck et al.
5,614,798 A 3/1997 Zydek et al.
5,889,376 A 3/1999 Takatsuka et al.
5,992,383 A 11/1999 Scholten et al.
6,488,006 B2 * 12/2002 Pursifull ..... 123/339.25
6,539,918 B1 * 4/2003 Pursifull ..... 123/399

FOREIGN PATENT DOCUMENTS

DE 3608555 A 9/1987
JP 403226283 * 10/1991

* cited by examiner

*Primary Examiner*—Mahmoud Gimie
*Assistant Examiner*—Arnold Castro
(74) *Attorney, Agent, or Firm*—John E. Kajander

(57) ABSTRACT

A method for controlling a positioning device (34) of an internal combustion engine includes the step of providing an electric motor (30) for actuating a positioning device (34). A user employs an actuator (21) to command the throttle plate (34) to change to a commanded position. A motor effort sensor (38) then detects a control effort required by the motor (30) to change to the commanded position. A throttle control unit (28) determines whether the control effort exceeds a threshold for a predetermined time period. If the control effort exceeds the threshold for the predetermined time period, the throttle control unit (28) actuates the motor (30) to reduce the control effort.

20 Claims, 2 Drawing Sheets

ELECTRONIC THROTTLE SERVO OVERHEAT PROTECTION SYSTEM

TECHNICAL FIELD

The present invention relates generally to control systems for internal combustion engines, and more particularly, to an electronic throttle servo temperature protection system.

BACKGROUND ART

Many previously known motor vehicle throttle controls have a direct physical linkage between an accelerator pedal and the throttle body so that the throttle plate is pulled open by the accelerator cable as the driver presses the pedal. The direct mechanical linkage includes biasing that defaults the linkage to a reduced operating position, in a manner consistent with regulations. Nevertheless, such mechanisms are often simple and unable to adapt fuel efficiency to changing traveling conditions, and add significant weight and components to the motor vehicle.

An alternative control for improving throttle control and the precise introduction of fuel air mixtures into the engine cylinders is accomplished by electronic throttle control. The electronic throttle control includes a throttle control unit that positions the throttle plate by an actuator controlled by a microprocessor based on the current operating state determined by sensors. The processors are often included as part of a powertrain electronic control that can adjust the fuel air intake and ignition in response to changing conditions of vehicle operation as well as operator control. Protection may be provided so that an electronic system does not misread or misdirect the control and so that unintended operation is avoided when portions of the electronic control suffer a failure.

Typically, the actuator or servomotor used to position the throttle plate is designed to have the maximum control effort available (motor voltage, current, duty cycle) to enhance throttle plate position response. Having a large control effort continuously available or available for maximum effort could possibly lead to overstressing the system's physical components if a blockage of the throttle plate occurs or the mechanism encounters a mechanical limit. For example, a mechanical limit may be an open stop or a close stop. Specifically, the H-driver and the servomotor could overheat with sustained full control effort under some environmental conditions. In an effort to avoid permanent damage, some electronic systems shut down when they get to a threshold temperature.

The disadvantages associated with these conventional electronic throttle overheat protection techniques have made it apparent that a new technique for electronic throttle overheat protection is needed. The new technique should allow full control effort while preventing overheat conditions. The present invention is directed to these ends.

SUMMARY OF THE INVENTION

It is, therefore, an object of the invention to provide an improved and reliable electronic throttle servo temperature protection system. Another object of the invention is to allow full control effort while preventing overheat conditions.

In accordance with the above and other objects of the present invention, an electronic throttle servo overheat protection system is provided. In one embodiment of the invention, a method for controlling a positioning device associated with internal combustion engine control is provided. In accordance with the method, an electric motor actuates the positioning device. The positioning device is then commanded to change to a commanded position. The control effort required to change to the commanded position is detected. It is then determined whether the control effort exceeds a threshold for a predetermined time period. When the control effort exceeds the threshold for the predetermined time period, the control effort is reduced.

The present invention thus achieves an improved electronic throttle servo overheat protection system. The present invention is advantageous in that it will not cause mechanism failure or require significant and costly added robustness to the mechanism.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

The present invention is illustrated herein with respect to an electronic throttle servo overheat protection system, particularly suited for the automotive field. However, the present invention is applicable to various other uses that may require electronic throttle servo overheat protection systems.

Figure 1:
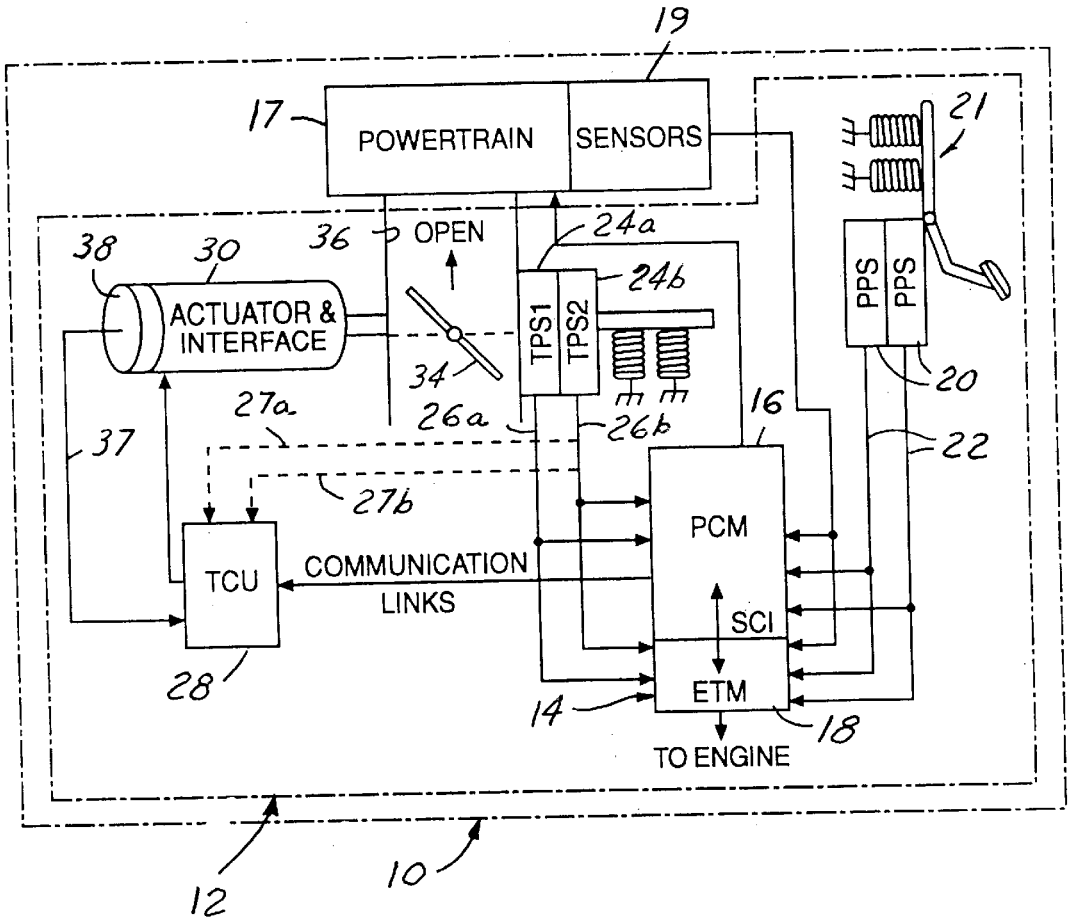
FIG. 1 is a block diagram of an electronic throttle servo overheat protection system in accordance with one embodiment of the present invention.

Referring to FIG. 1, a motor vehicle powertrain system 10 including electronic throttle control system 12 includes an electronic control unit 14. In the preferred embodiment, the electronic control unit 14 includes a powertrain control module (PCM) 16, including a main processor and an electronic throttle monitor (ETM) 18, including an independent processor. The PCM and ETM each share sensors 19 and actuators that are associated with the powertrain system 17 and control module 16. Preferably, the electronic throttle monitor 18 includes a processor physically located within the powertrain control module housing, although a separate housing, separate locations and other embodiments can also be employed in practicing the invention. Moreover, while the electronic throttle monitor 18 and the powertrain control module 16 have independent processors, they preferably share the inputs and outputs of powertrain sensors 19 and actuators 21 and 34, respectively, for independent processing.

A wide variety of inputs are represented in the diagram of FIG. 1 by the diagrammatic representation of redundant pedal position sensors 20. The sensors 20 are coupled through inputs 22 and are representative of many different driver controls that may demonstrate the demand for power. In addition, the electronic control unit 14 includes inputs 26*a* and 26*b* for detecting throttle position. A variety of ways for providing such indications are diagrammatically represented in FIG. 1 by a first throttle position sensor 24*a* and a redundant second throttle position sensor 24*b* to obtain a power output indication. As a result of the many inputs represented at 19, 22, 26*a* and 26*b*, the electronic controller 14 provides outputs for limiting output power so that the output power does not exceed the power demand. A variety of outputs are also diagrammatically represented in FIG. 1 by the illustrated example of inputs to a throttle control unit 28 that in turn powers an actuator and motor interface 30 for displacing the throttle plate 34. For example, an actuator and interface may comprise redundant drive motors powering a gear interface to change the angle of the throttle plate 34 in the throttle body 36.

Likewise, the responsive equipment, such as a motor, may also provide feedback. For example, the motor effort sensor 38 or the throttle position sensors 24*a* and 24*b* may provide feedback to the throttle control unit 28, as shown at 37, 27*a* and 27*b*, respectively, to determine whether alternative responses are required or to maintain information for service or repair.

Figure 2:
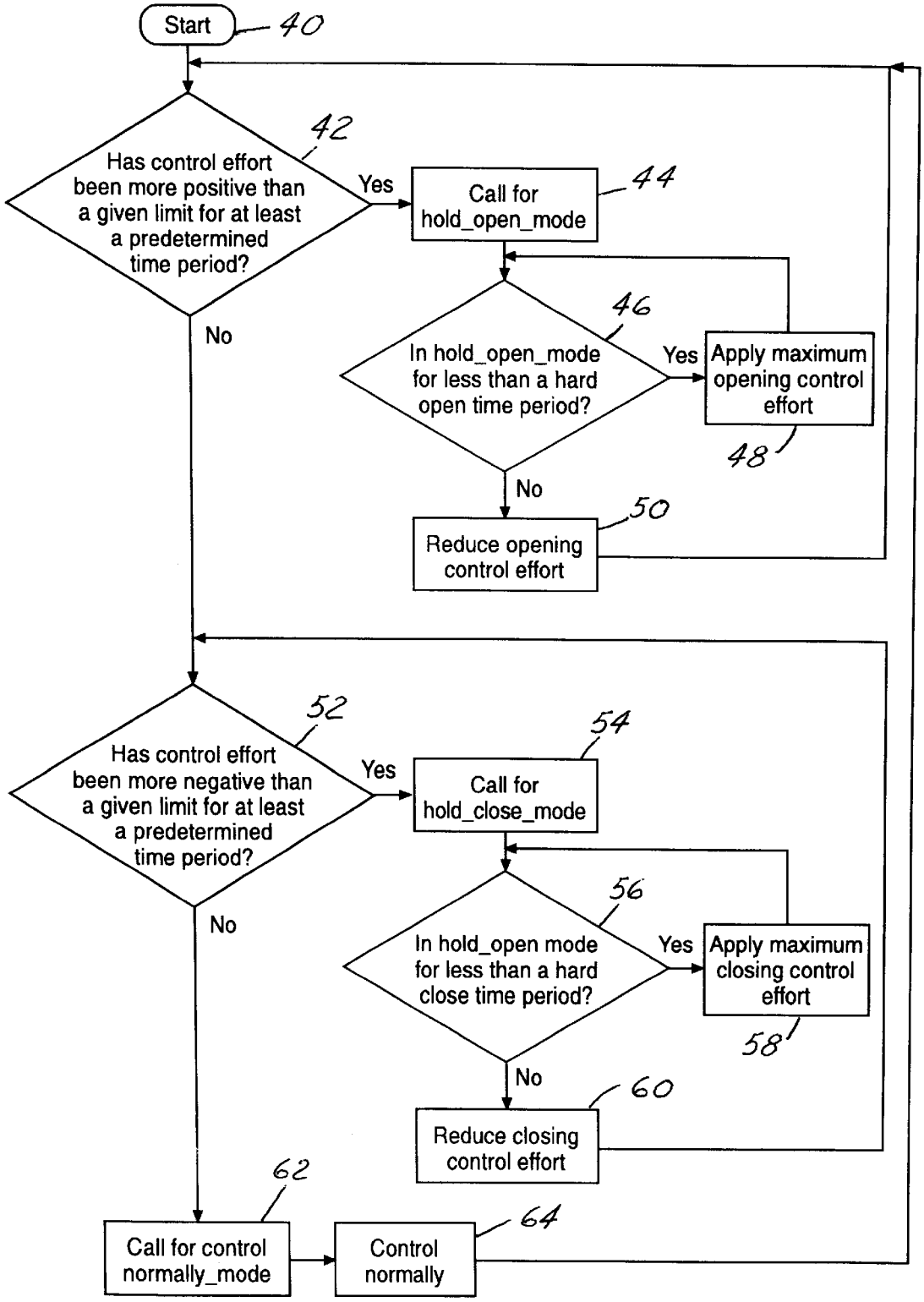
FIG. 2 is a flow chart depicting a method of providing electronic throttle servo overheat protection in accordance with one embodiment of the present invention.

Referring to FIG. 2, a flow chart depicting a method of providing electronic throttle servo overheat protection in accordance with one embodiment of the present invention is illustrated. In operation, the preferred method of the present invention is initiated at step 40 and immediately proceeds to step 42. In step 42, the controller preferably determines if the control effort has been more positive than a predetermined limit for at least a predetermined time period. Typically, an effort limit of approximately +6 volts and a contiguous time interval of about 300 milliseconds are used. Obviously, these values may vary as required. If the predetermined threshold has been exceeded, then the sequence proceeds to step 44.

A hold open mode is initiated at step 44 and the immediately continued in step 46. In step 46, the controller preferably determines if it has called for the hold open mode for less than a hard open time period. A person skilled in the art understands that the hard open time period may depend upon the voltage applied to the motor. For example, a given servo motor would not overheat under the following conditions:

| Positioning Effort (volts) | Duration (seconds) |
|---|---|
| 18 | 10 |
| 16 | 12 |
| 14 | 18 |
| 12 | 32 |
| 10 | 62 |
| 9 | 82 |
| 8 | 128 |
| 7 | 219 |
| 6 | 445 |
| 5 | indefinite |

These operating conditions may keep a motor at less than a threshold temperature to prevent overheating. For example, a threshold temperature may be 220 degrees Celsius.

If the throttle plate has been in a hold open mode for less than the hard open time period, then the sequence proceeds to step 48. In step 48, the controller preferably applies a maximum opening control effort to the motor. In the hold open mode, a typical maximum opening control effort has a magnitude of +14.5 volts. Obviously, the magnitude of the effort may vary as required. Then, the sequence returns to step 46. If the throttle plate has been in the hold open mode for longer than the hard open time period, then the sequence proceeds to step 50.

In step 50, the controller preferably reduces the opening control effort applied to the motor to a moderate opening control effort. The moderate opening control effort can be applied to the motor for an indefinite period of time without permitting the motor to overheat. Typically, the moderate opening effort has a magnitude of approximately +5 volts. Then, the sequence returns to step 42.

Thus, the following sequence typically occurs when the controller is in the hold open mode. First, the system detects that it should go into the hold open mode. Then, full voltage is applied to clear or crush any small debris obstructing movement of the throttle plate. The voltage is reduced to approximately +5 volts to prevent the motor from overheating.

If in step 42 the effort has not been more positive, then the sequence proceeds to step 52. In step 52, the controller preferably determines if the control effort has been more negative than a predetermined limit for at least a predetermined time period. Typically, an effort limit of approximately −6 volts and a contiguous time interval of about 300 milliseconds are used. If the predetermined threshold has been exceeded, then the sequence proceeds to step 54.

A hold close mode is initiated in step 54 and then immediately continued in step 56. In step 56, the controller preferably determines whether it has called for a hold close mode for less than a hard close time period. A typical time period is approximately 30 milliseconds. If the throttle plate has been in the hold close mode for less than the hard close time period, then the sequence proceeds to step 58.

In step 58, the controller applies a maximum closing control effort to the motor. In the hold close mode, a typical maximum closing control effort has a magnitude of −14.5 volts. Then, the sequence returns to step 56. If the throttle plate has been in the hold close mode for longer than the hard close time period, then the sequence proceeds to step 60.

In step 60, the controller reduces the closing control effort applied to the motor to a moderate closing control effort. The moderate closing control effort can be applied to the motor for an indefinite period of time without permitting the motor to overheat. Typically, a moderate control effort of approximately −5 volts is applied to the motor. Then, the sequence returns to step 52.

Thus, the following sequence typically occurs when the controller is in the hold close mode. First, full voltage is applied to clear or crush any small debris obstructing throttle plate movement. Then, approximately −5 volts is applied to hold the plate against the close stop for a period of time determined by the method of the present invention. A voltage approximately equal to −5 volts typically prevents the motor from overheating. Then the sequence returns to step 52.

If in step 52 the effort has not been more negative than a predetermined limit for a given time period, then the sequence proceeds to step 62. In step 62, the controller initiates a control normal mode. Subsequently, the sequence immediately proceeds to step 64 in which the controller controls the throttle plate normally. The sequence then returns to step 42.

The present invention thus achieves an improved and reliable electronic throttle servo overheat protection system by monitoring when the closing or opening control effort exceeds a threshold for a given amount of time. In this way, the present invention allows full control effort while preventing overheat conditions. Additionally, the present invention does not cause mechanism failure or require significant and costly added robustness to the mechanism.

From the foregoing, it can be seen that there has been brought to the art a new and improved electronic throttle servo overheat protection system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims.

What is claimed is:

1. A method for controlling a positioning device of an internal combustion engine, the method comprising the steps of:

providing an electric motor for actuating the positioning device;

commanding the positioning device to change to a commanded position;

detecting a control effort required to change to said commanded position;

determining whether said control effort exceeds a threshold for a predetermined time period; and reducing said control effort when said control effort exceeds said threshold for said predetermined time period;

wherein commanding the positioning device to change to said commanded position comprises at least one of commanding the positioning device to open to a hold open mode and commanding the positioning device to dose to a hold close mode.

2. The method as recited in claim 1, wherein said threshold has an absolute value of 6 volts.

3. The method as recited in claim 1, wherein said predetermined time period is 300 milliseconds.

4. The method as recited in claim 1, further comprising the step of applying a maximum control effort to the positioning device for a hard open time period.

5. The method as recited in claim 4, wherein said maximum control effort is +14.5 volts.

6. The method as recited in claim 4, wherein said hard open time period is 30 milliseconds.

7. The method as recited in claim 1, wherein the step of commanding the positioning device to change to said commanded position, comprises commanding the positioning device to close to said commanded position in a hold close mode.

8. The method as recited in claim 7, further comprising the step of applying a maximum control effort to the positioning device for a hard dose time period.

9. The method as recited in claim 8, wherein said maximum control effort is −14.5 volts.

10. The method as recited in claim 8, wherein said hard close time period is 30 milliseconds.

11. A system for controlling a positioning device of an internal combustion engine to prevent overheat conditions, the system comprising:

an electric motor for actuating the positioning device with a control effort;

a control effort detector coupled to said electric motor and intended to detect said control effort; and a controller coupled to said electric motor and said control effort detector, said controller including control logic operative to command the positioning device to change to a commanded position, detect a control effort required to change to said commanded position, determine whether said control effort exceeds a threshold for a predetermined time period, and reduce said control effort when said control effort exceeds said threshold for said predetermined time period;

wherein said controller further includes control logic operative to command the positioning device to close to said commanded position in a hold close mode.

12. The system as recited in claim 11, wherein said threshold has an absolute value of 6 volts.

13. The system as recited in claim 11, wherein said predetermined time period is 300 milliseconds.

14. The system as recited in claim 11, wherein said controller further includes control logic operative to command the positioning device to open to said commanded position in a hold open mode.

15. The system as recited in claim 14, wherein said controller further includes control logic operative to apply a maximum control effort to the positioning device for said hard open time period.

16. The system as recited in claim 15, wherein said maximum control effort is +14.5 volts.

17. The system as recited in claim 15, wherein said hard open time period is 30 milliseconds.

18. The system as recited in claim 11, wherein said controller further includes control logic operative to command application of a maximum control effort to the positioning device for a hard close time period.

19. The system as recited in claim 18, wherein said maximum control effort is −14.5 volts.

20. The system as recited in claim 18, wherein said hard close time period is 30 milliseconds.

* * * * *